US011832697B2

(12) United States Patent
Grimes

(10) Patent No.: US 11,832,697 B2
(45) Date of Patent: Dec. 5, 2023

(54) HAIR EXTENSION AND WIG DRYING DEVICE

(71) Applicant: Susan Nicole Grimes, Raleigh, NC (US)

(72) Inventor: Susan Nicole Grimes, Raleigh, NC (US)

( * ) Notice: Subject to any disclaimer, the term of this patent is extended or adjusted under 35 U.S.C. 154(b) by 368 days.

(21) Appl. No.: 17/182,932

(22) Filed: Feb. 23, 2021

(65) Prior Publication Data

US 2021/0267340 A1 Sep. 2, 2021

Related U.S. Application Data

(63) Continuation of application No. PCT/US2021/019226, filed on Feb. 23, 2021.

(60) Provisional application No. 62/983,107, filed on Feb. 28, 2020.

(51) Int. Cl.
*A45D 20/08* (2006.01)
*A41G 5/00* (2006.01)
*A41G 3/00* (2006.01)

(52) U.S. Cl.
CPC ..... *A45D 20/08* (2013.01); *A41G 3/00* (2013.01); *A41G 5/004* (2013.01)

(58) Field of Classification Search
CPC ..... A41G 3/00; A41G 5/004; A41G 3/0083; F26B 3/04; F26B 3/06; F26B 9/003; F26B 9/066; F26B 21/08; F26B 23/04; F26B 25/22
USPC ..... 34/96, 97, 101
See application file for complete search history.

(56) References Cited

U.S. PATENT DOCUMENTS 3,188,752 A 6/1965 Skinner
3,691,647 A 9/1972 Snyder et al.
3,757,429 A 9/1973 Sumino
3,958,340 A 5/1976 Meyers
4,185,398 A 1/1980 LaMont
6,399,920 B1 * 6/2002 Guinn ..... F26B 25/06 219/400
9,788,629 B2 10/2017 Blum
(Continued)

FOREIGN PATENT DOCUMENTS

CN 205655616 U 10/2016
CN 109631501 A * 4/2019
(Continued)

OTHER PUBLICATIONS

WIPO; International Preliminary Report on Patentability for International Patent Application No. PCT/US2021/019226 dated Sep. 9, 2022, 7 pages.
(Continued)

*Primary Examiner* — John P Mccormack
(74) *Attorney, Agent, or Firm* — NK Patent Law

(57) ABSTRACT

Hair extension drying device includes an enclosure comprising a base and an upwardly extending wall surrounding the base. The wall is configured for receiving a top cover of the enclosure. A fan is coupled to the top cover with the fan being configured for circulating air within the enclosure. A heating unit is coupled to the base. A hair extension holder spaced apart from the heating unit by one or more vertical supports. The hair extension holder includes at least one laterally extending plate that includes perforations or fluid pathways.

19 Claims, 7 Drawing Sheets

(56) References Cited

U.S. PATENT DOCUMENTS

| | | | | |
|---|---|---|---|---|
| 9,826,812 | B2 | 11/2017 | Sterling | |
| 10,000,887 | B2 | 6/2018 | Salazar | |
| 2008/0282576 | A1* | 11/2008 | Ueda | A45D 27/48 34/562 |
| 2009/0260256 | A1* | 10/2009 | Beaulac | D06F 58/38 34/108 |
| 2010/0083520 | A1 | 4/2010 | Bertakis | |
| 2013/0104922 | A1 | 5/2013 | Hall et al. | |
| 2013/0167396 | A1* | 7/2013 | Mitchell | F26B 25/06 34/223 |
| 2016/0219957 | A1 | 8/2016 | Dodds | |
| 2016/0286880 | A1 | 10/2016 | Adjesson | |
| 2017/0105501 | A1* | 4/2017 | Palmer | A45D 44/04 |
| 2017/0254588 | A1* | 9/2017 | McCloud | F26B 23/04 |
| 2018/0132597 | A1 | 5/2018 | Girod | |
| 2021/0145991 | A1* | 5/2021 | Moughton | A61L 2/24 |

FOREIGN PATENT DOCUMENTS

| | | | |
|---|---|---|---|
| CN | 110017677 | A | 7/2019 |
| GB | 2526043 | A | 11/2015 |
| JP | 2007016360 | A | 1/2007 |

OTHER PUBLICATIONS

"Fresh Wig Head Dryer", Amazon, Jul. 16, 2018, https://www.amazon.com/Fresh-Wig-Head-Dryer-Daroko/dp/B076FB8X19, 4 pages.

ISA/KR; International Search Report and Written Opinion for International Patent Application No. PCT/US2021/019226 dated Jun. 14, 2021, 11 pages.

* cited by examiner

HAIR EXTENSION AND WIG DRYING DEVICE

CROSS-REFERENCE TO RELATED APPLICATIONS

This application is a continuation of International Patent Application No. PCT/US21/19226 filed on Feb. 23, 2021, which claims priority to U.S. Provisional Patent Application No. 62/983,107 filed on Feb. 28, 2020, the entire contents of which are incorporated by reference herein.

TECHNICAL FIELD

The present invention relates generally to hair products, and particularly to systems, devices and methods for drying hair extensions.

BACKGROUND

The statements in this section merely provide background information related to the present disclosure and may not constitute prior art.

Sometimes a person may desire to augment their appearance with hair extensions, also called hair weaves, (e.g., hair additions or artificial hair integrations) for the purposes of convenience and style. For example, a person's natural hair may require an inconvenient amount of time and work for appropriately styling their hair. As another example, a person having naturally curly hair, but desiring straight hair, may augment the hair with straight hair extensions to save time associated with hot ironing, which can cause burns or hair damage. A person may also augment the person's hair with straight hair extensions to bypass the need for applying harmful chemical straighteners. In some situations, hair additions may be applied to cover bald spots, thinning hair or damaged hair. Hair extensions can be used to add length, thickness and/or color to a person's existing hair. There are different types of commercially available hair extensions such as strand by strand extensions, for example. Strand by strand extensions typically involve the fusing of individual or small groups of extensions to the existing hair strand(s) on the person, by way of adhesives or light/heat radiation, whereas other methods involve braiding extensions to existing hair strands on a person's head using a method such as sewing on the hair extension.

It is important to regularly wash and condition hair extensions in order to prolong the life of the same, both when the hair is attached to a person's head/hair (i.e., installed) and when the hair is not attached to a person's head/hair (i.e., uninstalled). The dryer is used for hair extensions that are uninstalled and have not yet been installed onto a person's hair/head. Once the extensions have been washed and cleaned, they must then be thoroughly dried, prior to attaching/installing the hair extensions. Owing to the delicate nature of hair extensions, the drying process typically requires the user to carefully brush and blow dry the weave, in order to prevent the strands from becoming entangled. Although useful for preventing damage to the extensions, this process is laborious and extremely time consuming, taking upwards of several hours to completely dry. By blow-drying the hair, the texture of the hair extensions is dramatically altered, often becoming straight in texture. Such alteration of the hair extensions due to blow-drying can shorten the life of the extensions, thereby causing damage and premature wear and tear of the extensions.

Accordingly, opportunities exist for providing a self-contained hair extension drying device that can dry various types of hair extensions in a convenient manner.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

In accordance with the purposes of the disclosed devices and methods, as embodied and broadly described herein, the disclosed subject matter relates to devices and methods of use thereof. Additional advantages of the disclosed devices and methods will be set forth in part in the description, which follows, and in part will be obvious from the description. The advantages of the disclosed devices and methods will be realized and attained by means of the elements and combinations particularly pointed out in the appended claims. It is to be understood that both the foregoing general description and the following detailed description are exemplary and explanatory only and are not restrictive of the disclosed compositions, as claimed.

The details of one or more embodiments of the invention are set forth in the accompanying drawings and the description below. Other features, objects, and advantages of the invention will be apparent from the description and drawings, and from the claims.

Implementations may include one or more of the following features. Disclosed herein is a hair extension drying device. In various embodiments, the hair extension drying device includes an enclosure comprising a base and an upwardly extending wall surrounding the base, the wall operable to a top cover of the enclosure. The device also includes a fan coupled to the top cover, the fan operable to circulate air within the enclosure, and a heating unit coupled to the base. The device further includes a hair extension holder spaced apart from the heating unit by one or more vertical supports, the hair extension holder comprising at least one laterally extending plate.

According to one or more embodiments, the top cover includes a locking mechanism that secures the top cover to the wall.

According to one or more embodiments, the heating unit comprises a housing secured to the base, wherein the housing comprises an airflow generator.

According to one or more embodiments, the airflow generator generates a negative airflow.

According to one or more embodiments, the laterally extending plate comprises perforations or fluid pathways for allowing airflow therethrough.

According to one or more embodiments, the laterally extending plate comprises two lateral plates in a hinged relationship such that the two lateral plates are operable to receive the hair extension therebetween.

According to one or more embodiments, the enclosure further comprises one or more openings defined on the wall for air circulation.

According to one or more embodiments, at least two of the openings are positioned on opposing sides of the wall.

According to one or more embodiments, at least one opening includes a blower for providing positive air flow or negative flow therethrough.

According to one or more embodiments, the device further comprises a humidity sensor positioned within the enclosure.

According to one or more embodiments, the device further comprises a controller coupled with the enclosure, wherein the controller automatically turns off one or more of the fan and the heating unit when the humidity as measured by the humidity sensor is below a predetermined value.

According to one or more embodiments, the device further comprises a controller coupled with the enclosure, wherein the controller automatically turns off one or more of the fan and the heating unit after a predetermined period of time.

According to one or more embodiments, the device further comprises a graphical user interface (GUI) provided on the enclosure, wherein the GUI is in communication with a controller coupled with the enclosure, wherein the controller is operable to control operations of one or more of the fan, the heating unit and the GUI.

According to one or more embodiments, the device further comprises a graphical user interface (GUI) provided on the enclosure, wherein the GUI is in communication with a controller coupled with the enclosure, wherein the controller directs operations of one or more of the fan, the heating unit and the GUI.

According to one or more embodiments, one or more of the top cover and the wall is constructed from a clear material.

According to one or more embodiments, the laterally extending plate comprises two lateral plates in a hinged relationship, wherein a wig is received between the two lateral plates.

Provided herein is a hair extension drying device. According to various embodiments, the hair extension drying device includes an enclosure comprising a base and an upwardly extending wall surrounding the base, the wall operable to receive a top cover of the enclosure, the top cover including a plurality of vents defined thereon for air circulation. The device further includes two openings defined on the wall for air circulation, the two openings positioned on opposing sides of the wall. At least one of the two openings includes a blower that provides one of positive air flow and negative flow therethrough. A hair extension support comprising a plurality of prongs extending vertically from the base. In an operational disposition of the hair drying device, a hair extension is placed about the plurality of prongs, and air is circulated within the enclosure to remove moisture from the hair extension. According to one or more embodiments, the device further comprises a heating source coupled to at least one of the plurality of prongs whereby heat radiates from the at least one of the plurality of prongs to aid in drying the hair and maintaining texture, shine and integrity of the hair.

According to one or more embodiments, the device further comprises a heating unit coupled to the base.

According to one or more embodiments, the heating unit comprises a housing secured to the base.

According to one or more embodiments, the device further comprises a humidity sensor positioned within the enclosure.

According to one or more embodiments, the device further comprises a plurality of operating buttons positioned on a front facing portion of the wall of the enclosure.

According to one or more embodiments, the device further comprises a graphical user interface (GUI) provided on the enclosure, wherein the GUI is in communication with a controller coupled with the enclosure, wherein the controller is operable to control operations of one or more of the fan, the heating unit and the GUI.

According to one or more embodiments, disclosed herein is a method of drying a hair extension. In at least one embodiment, the method includes providing a hair extension drying device. The hair extension drying device includes an enclosure comprising a base and an upwardly extending wall surrounding the base, the wall operable to receive a top cover of the enclosure. The device further includes a fan coupled to the top cover, the fan operable to circulate air within the enclosure, and a heating unit coupled to the base. The device also includes a hair extension holder spaced apart from the heating unit by one or more vertical supports, the hair extension holder comprising at least one laterally extending plate. The method also includes placing a hair extension on the hair extension holder. The method further includes initiating circulation of heat generated by the heating unit within by turning on the fan and the heating unit; and removing moisture from the hair extension.

According to one or more embodiments, the laterally extending plate comprises two lateral plates in a hinged relationship, wherein the method further comprises placing the hair extension between the two lateral plates.

According to one or more embodiments, the method further comprises operating a blower positioned on an opening defined on the wall for providing positive air flow through the opening or negative air flow through the opening.

According to one or more embodiments, the hair extension drying device further comprises a humidity sensor positioned within the enclosure, and a controller coupled with the enclosure, the controller operable to automatically turn off one or more of the fan and the heating unit when the humidity as measured by the humidity sensor is below a predetermined value, wherein the method further comprises ceasing operations of the fan and the heating unit when the humidity as measured by the humidity sensor is below the predetermined value.

According to one or more embodiments, the hair extension drying device further comprises a controller coupled with the enclosure, the controller is operable to automatically turn off one or more of the fan and the heating unit after a predetermined period of time, wherein the method further comprises turning off of the fan and the heating unit after the predetermined period of time.

BRIEF DESCRIPTION OF THE DRAWINGS

In order to describe the technical solutions of the examples of the present invention more clearly, the figures required to be used for the examples will be briefly introduced below. It should be understood that the following figures only show some examples of the present invention, and thus shall not be construed as limiting the scope thereof; and for a person skilled in the art, further relevant figures could also be obtained according to the figures without using inventive efforts.

DETAILED DESCRIPTION OF THE EMBODIMENTS

Figure 1:
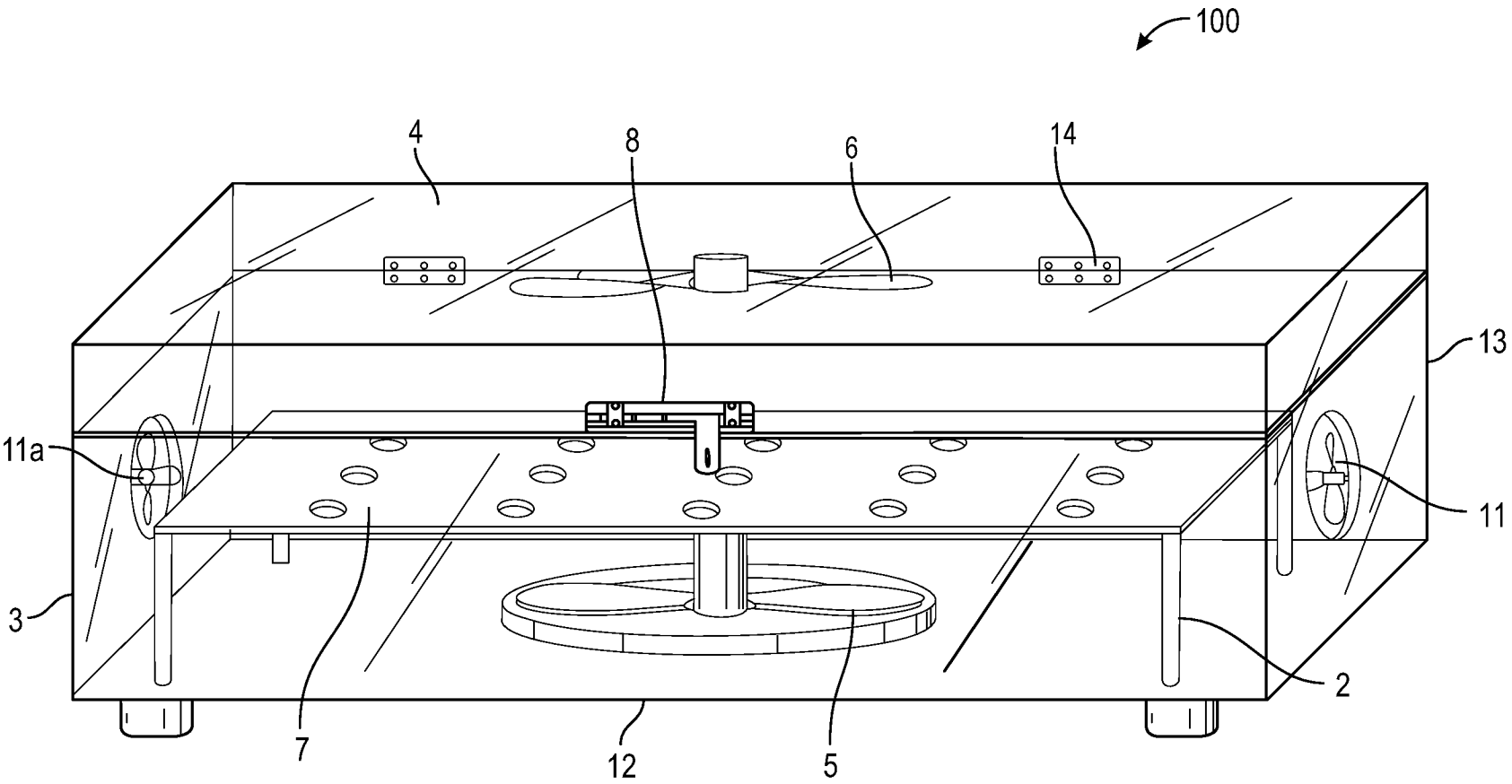
FIG. 1 illustrates a front perspective view of a hair extension drying device, according to one or more embodiments of the presently disclosed subject matter.

The following description and drawings are illustrative and are not to be construed as limiting. Numerous specific details are described to provide a thorough understanding of the disclosure. However, in certain instances, well-known or conventional details are not described in order to avoid obscuring the description. References to "one embodiment" or "an embodiment" in the present disclosure can be, but not necessarily are, references to the same embodiment and such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and is not intended to further limit the scope and meaning of the disclosure or of any exemplified term. Likewise, the disclosure is not limited to various embodiments given in this specification.

Without intent to limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

There are many different types of commercially available hair extensions, such as strand by strand extensions, bulk extensions, weft extensions (including bundles), clip-ins, closures, falls, keratin tips, and braids, for example. Strand by strand extensions typically involve the fusing of individual or small groups of extensions to the existing hair strand(s) on the person, by way of adhesives or light/heat radiation, whereas other methods involve braiding, sewing, latching, clipping, or gluing extensions to either existing hair strands, hair nets, or wig caps. Hair extensions are a multitude of materials and may be human hair (i.e., virgin remy hair), as well as synthetic and mixed materials. Hair extensions also come in a multitude of hair textures such as kinky, curly, coily, wavy, and straight.

As noted earlier, it is important to regularly wash and condition hair extensions in order to prolong the life of the same, both when the hair is attached to a person's head/hair (i.e., installed) and when the hair is not attached to a person's head/hair (i.e., uninstalled). The dryer is used for hair extensions that are uninstalled and have not yet been installed onto a person's hair/head. Once the extensions have been washed and cleaned, they must then be thoroughly dried, prior to attaching/installing the hair extensions. Owing to the delicate nature of hair extensions, the drying process typically requires the user to carefully comb, brush and blow dry the weave, in order to prevent the strands from becoming entangled. Although useful for preventing damage to the extensions, this process is laborious and extremely time consuming, taking upwards of several hours to completely dry. By blow-drying the hair, the texture of the hair extensions is dramatically altered, often becoming straight in texture. Such alteration of the hair extensions due to blow-drying can shorten the life of the extensions, thereby causing damage and premature wear and tear of the extensions. Embodiments of the presently disclosed subject matter can advantageously address several of the above-noted limitations and issues faced by users of hair extensions and hair weaves.

Embodiments of the presently disclosed subject matter provide for a hair extension drying device that is configured for both personal use and commercial use. As will be explained in detail, embodiments of the presently disclosed subject matter provide for effectively drying wet hair extensions by providing a source of heated airflow around the wet hair extensions held by a laterally extending plate that includes perforations or similar other fluid pathways, thus decreasing the drying time. For example, in various embodiments, the laterally extending plate can be made of a mesh material (e.g., wire mesh, metal mesh, plastic mesh, or similar other construction). In some embodiments, the laterally extending plate can constructed of a sponge-like material. In some embodiments, the laterally extending plate can be a smooth flat plate. In some embodiments, the laterally extending plate may not include any openings. Embodiments of the presently disclosed subject matter provide for simple operations, ease of loading and removal of hair extensions, increased capacity for loading more than one hair extension at a time, limiting and/or preventing tangling of hair during the drying cycle, and providing both positive and negative heated airflow, among others. Thus, embodiments of the presently disclosed subject matter advantageously provide for a laterally extending plate that comprises perforations or a similar other mechanism or feature for allowing airflow therethrough. In some embodiments, the laterally extending plate comprises two lateral plates in an interconnected or hinged relationship such that the two lateral plates are configured for receiving the hair extension therebetween.

Figure 2:
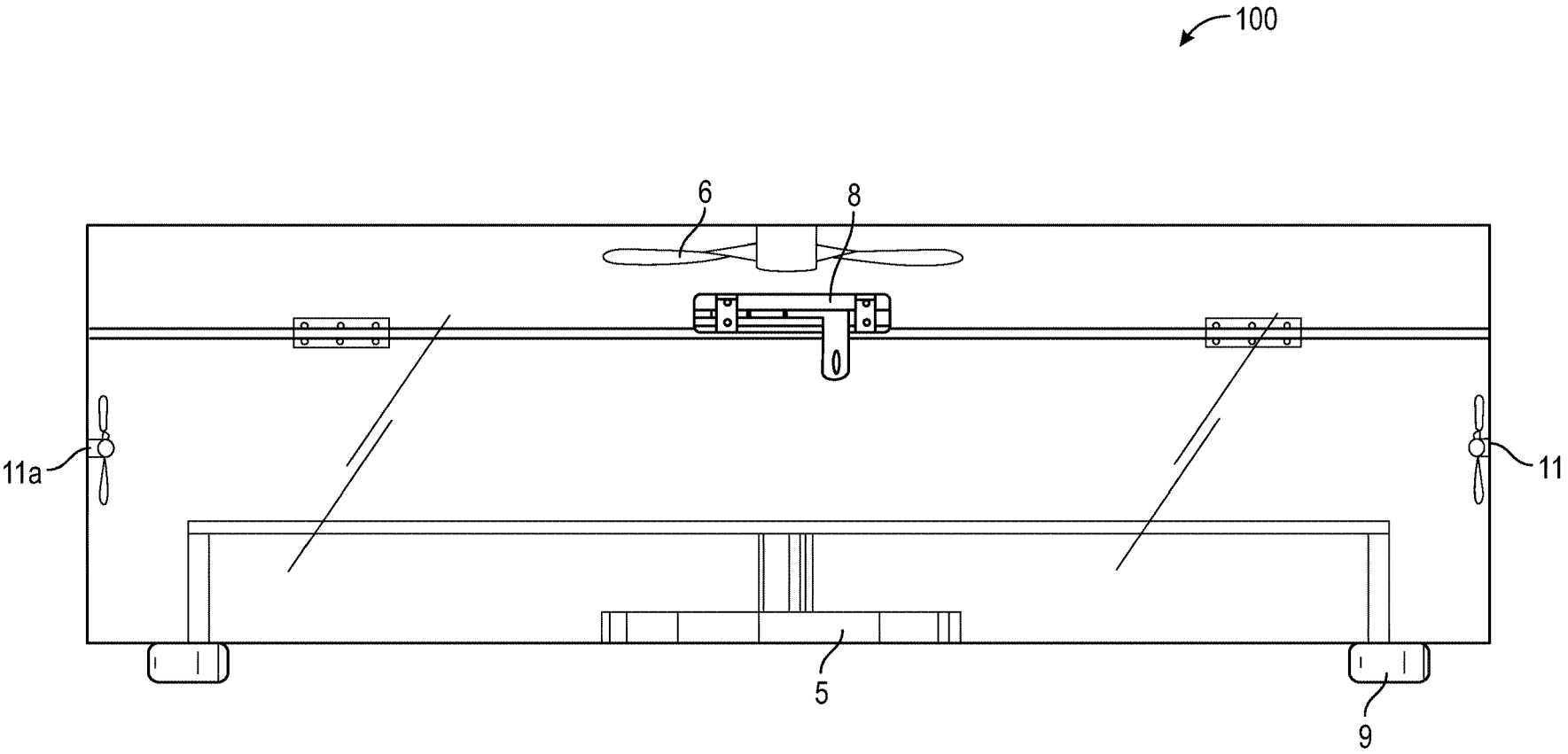
FIG. 2 illustrates a front plan perspective view of a hair extension drying device, according to one or more embodiments of the presently disclosed subject matter.
Figure 3:
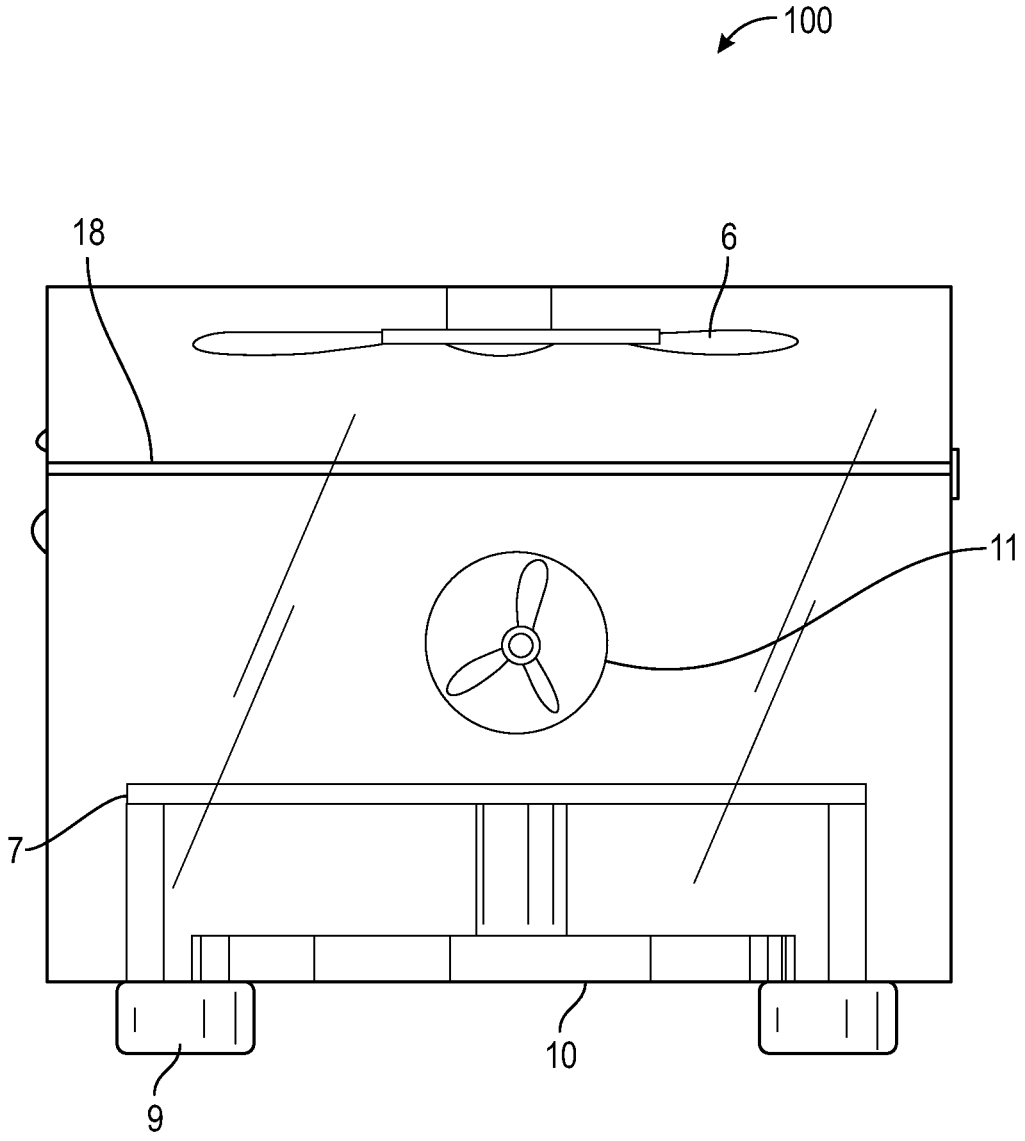
FIG. 3 illustrates a side plan view of a hair extension drying device, according to one or more embodiments of the presently disclosed subject matter.
Figure 4:
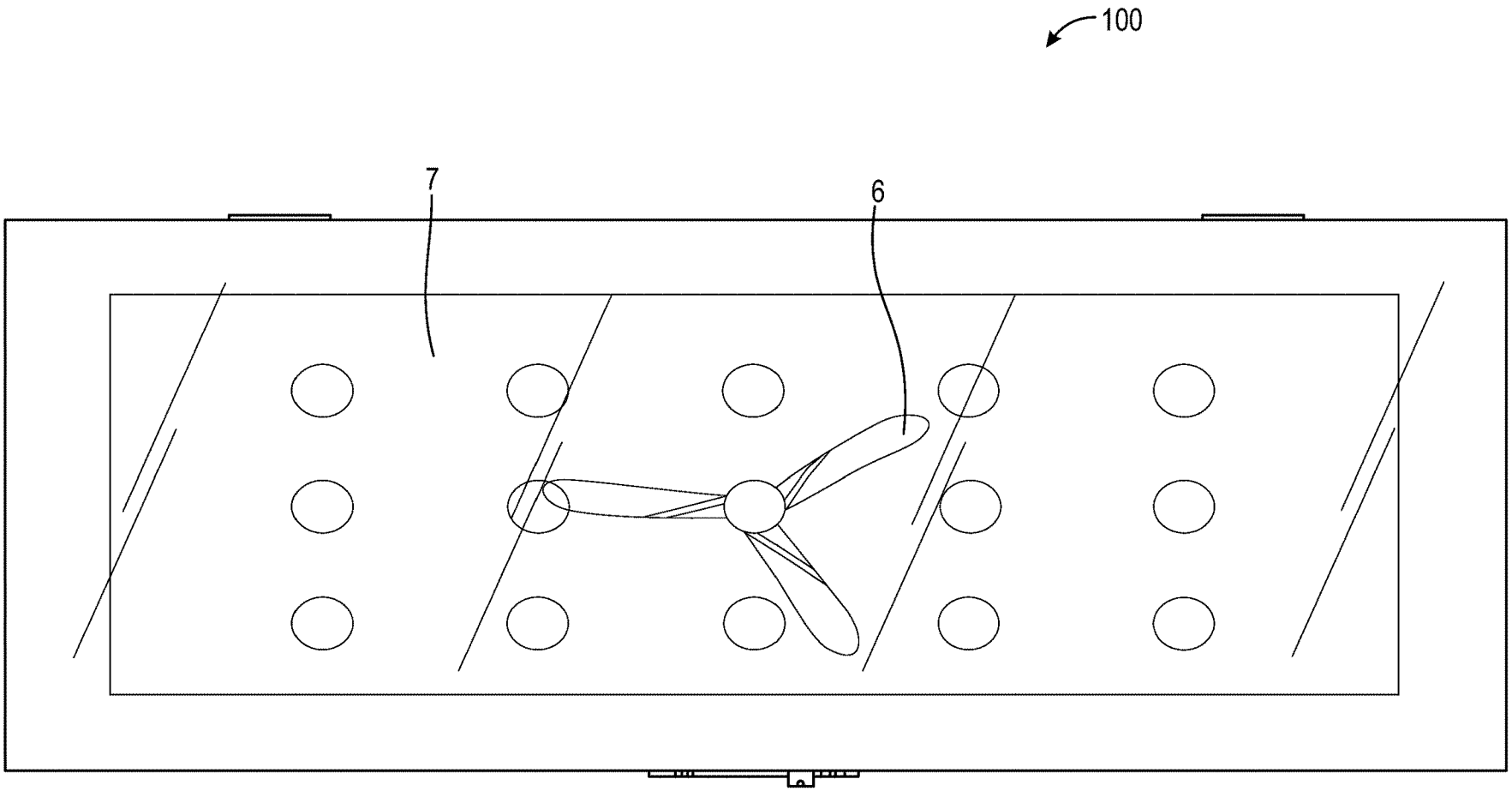
FIG. 4 illustrates a top plan view of a hair extension drying device, according to one or more embodiments of the presently disclosed subject matter.
Figure 5:
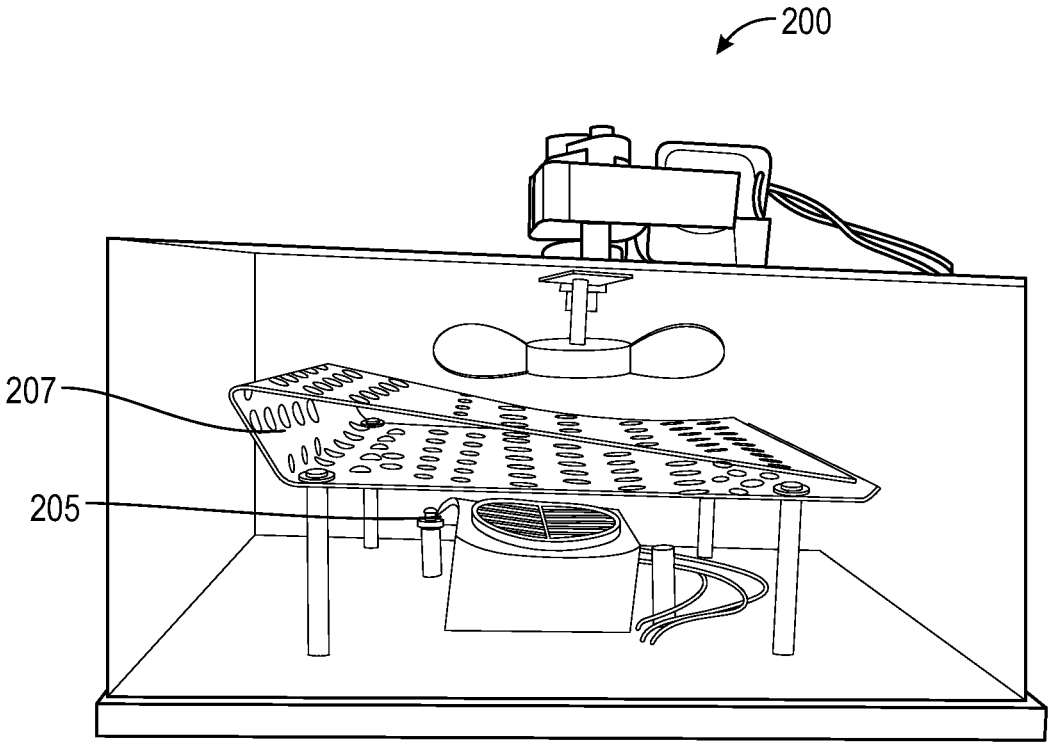
FIG. 5 illustrates a side perspective view of a hair extension drying device without a hair extension to be dried loaded therein, according to one or more embodiments of the presently disclosed subject matter.
Figure 6:
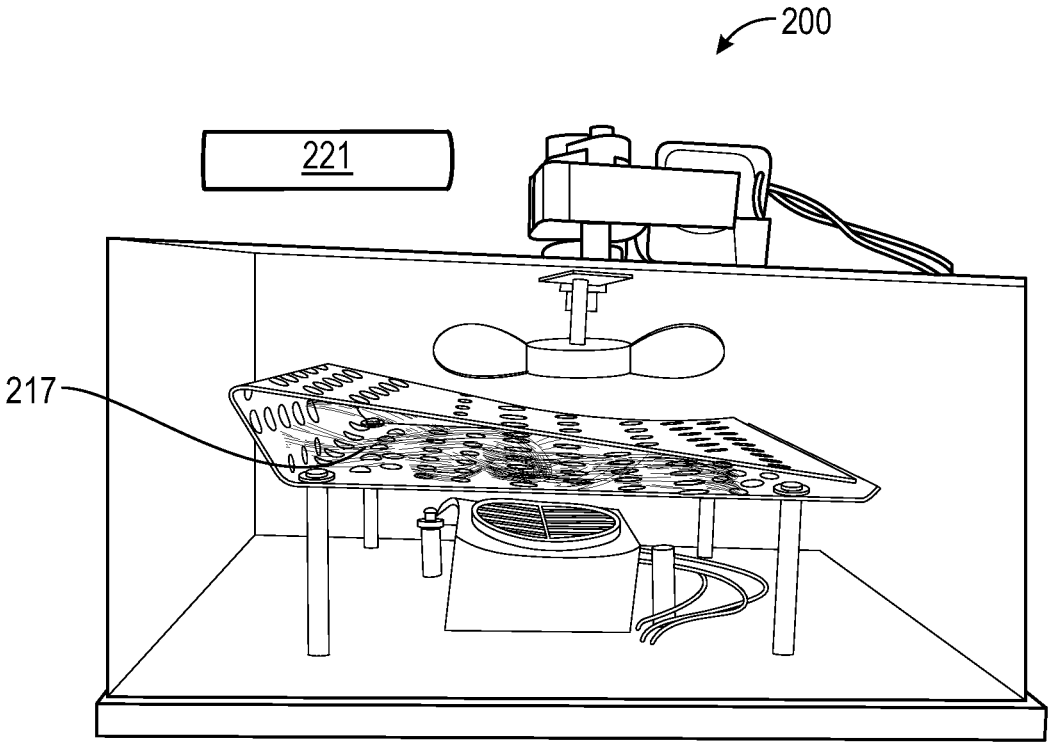
FIG. 6 illustrates a side perspective view of a hair extension drying device 200 with a hair extension to be dried loaded therein, according to one or more embodiments of the presently disclosed subject matter.
Figure 7:
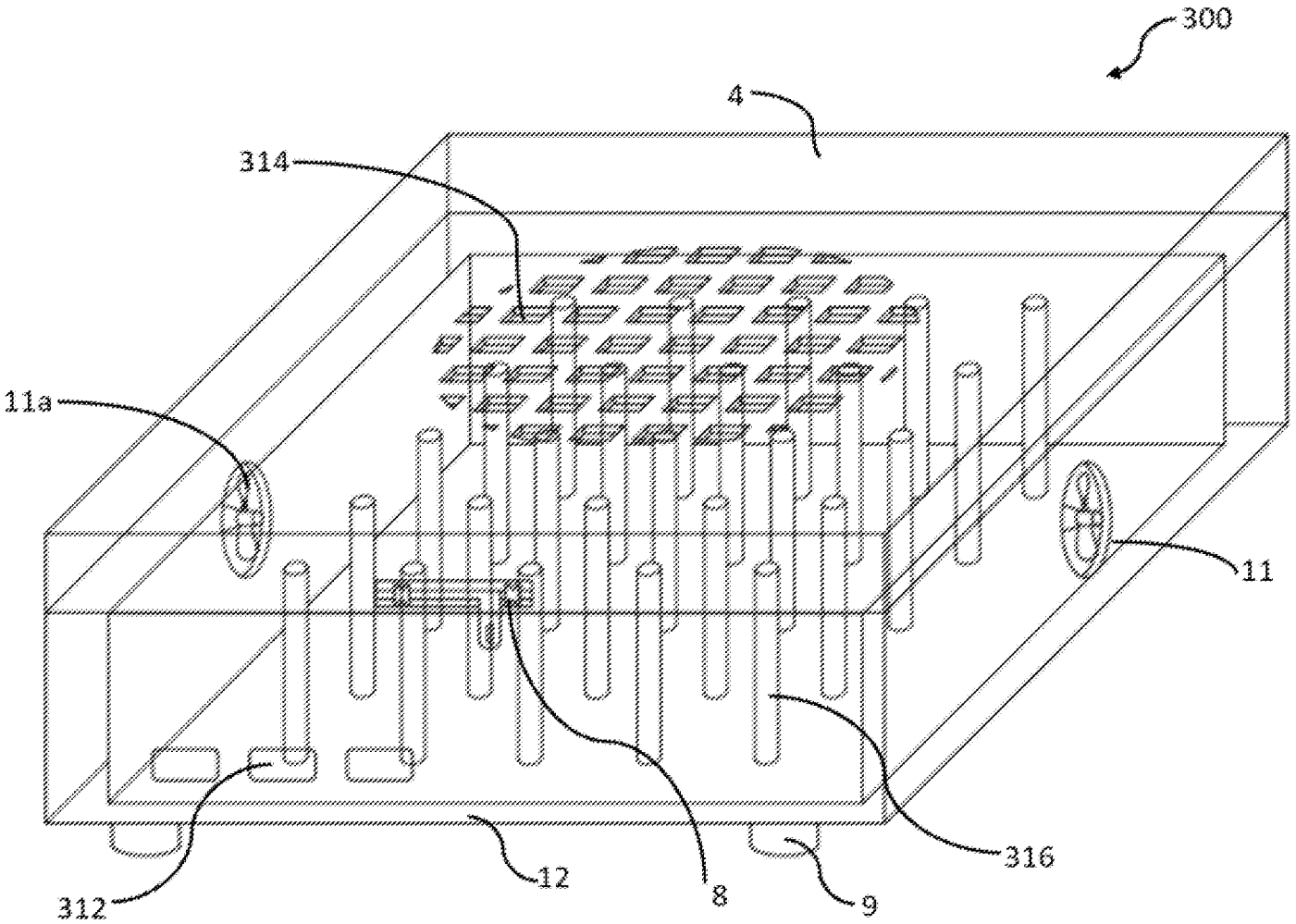
FIG. 7 illustrates a front perspective view of a hair extension drying device, according to one or more embodiments of the presently disclosed subject matter.

FIG. 1 illustrates a perspective view of hair extension drying device 100 according to one or more embodiments of the presently disclosed subject matter. FIG. 2 illustrates a front view of hair extension drying device 100 according to one or more embodiments of the presently disclosed subject matter. FIG. 3 illustrates a side view of hair extension drying device 100 according to one or more embodiments of the presently disclosed subject matter. FIG. 4 illustrates a top view of hair extension drying device 100 according to one or more embodiments of the presently disclosed subject matter. FIG. 5 illustrates a side perspective view of hair extension drying device 200 without a hair extension to be dried loaded therein according to one or more embodiments of the presently disclosed subject matter. FIG. 6 illustrates a side perspective view of hair extension drying device 200 with a hair extension to be dried loaded therein according to one or more embodiments of the presently disclosed subject matter. FIG. 7 illustrates a front perspective view of hair extension drying device 300, according to one or more embodiments of the presently disclosed subject matter.

According to at least one embodiment, as illustrated, for example, in FIGS. 1 through 4, a hair extension drying device 100 (alternately referred to herein simply as "device") includes an enclosure 3 comprising a base 12 and an upwardly extending wall 13 surrounding the base 12. Wall 13 configured for receiving a top cover 4 of the enclosure at rim 18 provide on wall 13. An air movement mechanism such as a fan 6 is coupled to the top cover 4. In at least one embodiment, top cover 4 is in a hinged relationship with wall 13, top cover 4 being connected with wall 13 by one or more hinges 14. In one embodiment, hinges 14 may be of metallic construction. Fan 6 is configured for circulating air within enclosure 3. In one embodiment, fan 6 can include blades made of brushed nickel. Hair extension drying device 100 further includes a heating unit 5 coupled to base. Heating unit 5 may be in the form of a heated vacuum source in one embodiment. Hair extension drying device 100 also includes a hair extension holder 7 spaced apart from heating unit 5 by one or more vertical supports or posts 2. In at least one embodiment, hair extension holder 7 comprises one or more laterally extending plates.

In at least one embodiment, top cover 4 includes a locking mechanism such as lock 8 for securing the top cover to the wall. During use, top cover 4 is opened, and a hair extension to be dried is placed on or within hair extension holder 7. After the hair extension to be dried is placed on or within hair extension holder 7, top cover 4 is closed, and lock 8 is locked such that top cover 4 is securely closed when the drying cycle of the device is turned on.

FIGS. 5 and 6 illustrate another embodiment of hair extension drying device in the form of hair extension drying device 200 (also alternately referred to herein simply as "device 200" or commonly as "device") according to one or more embodiments. Hair extension drying device 200 can include same or similar features as hair extension drying device 100 except as provided herein. For example, in some embodiments, as illustrated in FIGS. 5 and 6, hair extension drying device 200 includes a heating unit 205 that comprises a housing secured to base 12, with heating unit 205 further comprising an airflow generator such as a blower or a fan. In one embodiment, the air flow generator is configured for generating a negative airflow; accordingly, in one embodiment, while fan is configured to push air downwards, the airflow generator of heating unit 205 can be configured to pull air downwards (i.e., create a negative airflow) to thereby allow for effective air circulation. In another embodiment, while fan 6 is configured to pull air upwards (i.e., create a negative airflow), the airflow generator of heating unit 205 can be configured to push air upwards to thereby allow for effective air circulation. In some embodiments, base 12 can be supported by columns 9, with columns 9 operating to elevate hair extension drying device 100 off of a flat surface on which hair extension drying device 100 may be placed. In some embodiments, base 12 may define one or more openings 10 to permit fluid flow (air, moisture and/or water) therethrough to thereby accelerate the drying of a hair extension being placed within hair extension drying device 100. Further, as illustrated in FIGS. 5 and 6, according to at least one embodiment, hair extension drying device 200 can include a hair extension holder 207 that comprises two lateral plates in a connected or interconnected relationship (e.g., in the form of a hinged relationship) such that the two lateral plates are configured for receiving the hair extension therebetween (see FIG. 6). Accordingly, during use, one of the two lateral plates may be lifted/opened to expose a substantially flat surface of the other lateral plate, and the hair extension to be dried is placed on the other lateral plate, and the lifted/opened lateral plate is placed back to form a configuration as illustrated in FIG. 6.

In various embodiments, enclosure 3 can further comprise one or more openings or vents defined on wall 13 for air circulation. In some embodiments, enclosure 3 can further comprise one or more openings or vents defined on base 12 for air circulation and fluid flow therethrough. In at least one embodiment, a first opening 11 and a second opening 11*a* are positioned on opposing sides of the wall 13 as illustrated, for e.g., in FIG. 2. Accordingly, in various embodiments, each of one or more openings or vents are provided with a blower each for providing positive air flow or negative flow therethrough. For example, in one embodiment, a blower provided on the first opening 11 provides positive air flow while another blower provided on the second opening 11*a* provides negative air flow, or vice versa. In some embodiments, two openings may be defined on wall 13 for air circulation of which only one opening may include a blower for providing positive air flow or negative flow therethrough while the other opening may not include a blower. In one embodiment, while a blower provided on first opening 11 provides positive air flow (i.e., pushes air into the enclosure), a further blower provided on second opening 11*a* provides negative air flow (i.e., sucks air out of the enclosure); similarly, in another embodiment, while a blower provided on first opening 11 provides negative air flow (i.e., sucks air out of the enclosure), a further blower provided on second opening 11*a* provides positive air flow (i.e., pushes air into the enclosure). In one embodiment, first opening 11 may be positioned diagonally across from second opening 11*a*. These features, in addition to perforations or similar other fluid pathways provided on hair extension holder 7 as well as the openings provided in base 12 can operate to further accelerate the drying of a hair extension being placed within hair extension drying device 100.

FIG. 7 illustrates another embodiment of hair extension drying device in the form of hair extension drying device 300 (also alternately referred to herein simply as "device 300" or commonly as "device") according to one or more embodiments. Hair extension drying device 300 can include same or similar features as hair extension drying device 100 and/or as hair extension drying device 200 except as provided herein. As illustrated in FIG. 7, according to various embodiments, hair extension drying device 300 can include a plurality of pegs such as prongs 316 for supporting a hair extension to be dried within the enclosure of hair extension drying device 300. In various embodiments, prong 316 can be formed of materials such as titanium, ceramic, tourmaline, metal, silicone, plastic, foam, or similar other materials or combinations thereof. In one embodiment, wet hair extension 217 can be placed on prongs 316 that extend upwardly from base 12. In some embodiments, wet hair extension 217 may be further intertwined through prongs 316.

Device 300 can additionally include vents 314 provided on top cover 4. Vents 314 provide for air and fluid circulation. In such embodiments, vents 314 can provide for heat to escape. For example, vents 314 provide for hot or warm moist air to escape therethrough. This way hair heated by an airflow generator of a heating unit such as heating unit 205 can be circulated by blowers provided on opening 11 and/or opening 11*a*, whereby the heated air can remove moisture from a wet hair extension 217 placed about prongs 316. In one embodiment, hair extension drying device 300 may not include a fan such fan 6 provided on top cover 4.

In one embodiment, hair extension drying device 300 may further include a heating unit such as heating unit 205 that comprises a housing secured to base 12. Heating unit 205 of hair extension drying device 300 may or may not include an airflow generator such as a blower or a fan. In some embodiments, hair extension drying device 300 may not include a heating unit such as heating unit 205. Columns 9 operate to elevate hair extension drying device 300 off of a flat surface. Columns 9 may be made of materials such as rubber, silicone, metal, plastic, and similar other materials.

In some embodiments, hair extension drying device 300 can further a plurality of operating buttons 312 provided on the sidewall of the enclosure for hair extension drying device 300. Operating buttons 312 can be used to control operations of hair extension drying device 300. One of the operating buttons 312 may be a power on/off button. One or more addition buttons may be operable to control the heating temperature within enclosure 3. In one embodiment, the operating buttons 312 may allow for settings such as: hot, warm, cool and similar other settings. In various embodiments, hair extension drying device 300 can include 2, 3, 4, 5 or more temperature settings, with the temperatures ranging between 100 degrees Fahrenheit and 450 degrees Fahrenheit, for example. In various embodiments, hair extension drying device 300 can include 2, 3, 4, 5 or more moisture level settings for the interior of enclosure 3. In one embodiment, the heating unit 205 can include ionic technology. In various embodiments, base 12 of hair extension drying device 300 can include slits, perforations or openings provided thereon, with these slits, perforations or openings operating to further accelerate the drying of a moist or wet hair extension being placed within hair extension drying device 300. In addition to hair extensions, hair extension drying device 300 can also be used to dry wigs. In some embodiments, hair extension drying device 300 can operate to just aerate a hair extension or a wig.

According to at least one embodiment, hair extension drying device 300 includes enclosure 3 comprising base 12 and upwardly extending wall 13 surrounding base 12. Wall 13 is operable to receive top cover 4 of enclosure 3. Top cover 4 includes a plurality of vents 314 defined thereon for air circulation. Hair extension drying device 300 can further include two openings defined on the wall for air circulation, the two openings (for e.g., first opening 11 and second opening 11*a*) positioned on opposing sides of wall 13. At least one of the two openings can include a blower that provides one of positive air flow and negative flow therethrough. A hair extension support comprising a plurality of prongs 316 extend vertically from base 12. In an operational disposition of the hair drying device, a moist or wet hair extension 217 or a moist or wet wig is placed about the plurality of prongs 316, and air is circulated within the enclosure 3 to remove moisture from the moist or wet hair extension 217 or the wig. In one embodiment, the air circulating within the enclosure 3 may be heated by a heating unit such as heating unit 205 positioned within enclosure 3 (not illustrated in FIG. 7).

In various embodiments, each of hair extension drying device 100, hair extension drying device 200 and hair extension drying device 300 can further comprise a controller 221 that is electrically (and optionally mechanically) coupled to enclosure 3. Controller 221 is configured for controlling the operations of hair extension drying device 100. In at least one embodiment, controller 221 may be configured for automatically turning off the fan, the heating unit, and any other electronically controllable components of the hair extension drying device that are in a communicative relationship with the controller. The other electronically controllable components may include one or more humidity sensors, one or more temperature sensors, one or more smoke detectors (to detect for presence of smoke within the enclosure and to turn off the hair extension drying device as soon as smoke is detected), and at least one graphical user interface, among others. In various embodiments, the one or more humidity sensors may be positioned within the enclosure. In one embodiment, the controller is configured for automatically turning off the hair extension drying device (for e.g., by turning off fan 6 and heating unit 5) when the humidity as measured by the humidity sensor falls below a predetermined value. In the same or in a different embodiment, the controller is configured for automatically turning off the hair extension drying device (for e.g., by turning off fan 6 and heating unit) after a predetermined period of time as programmed in an internal memory of the hair extension drying device has lapsed. The internal memory (or simply "memory") is in communication with the controller. In at least one embodiment, the controller is configured for receiving inputs at the graphical user interface (GUI) provided on the enclosure, wherein the controller is configured for controlling operations of one or more of the fan, the heating unit and any other components of the hair extension drying device in communication with the controller based on inputs received at the GUI. In at least one embodiment, the controller is configured for controlling operations of one or more of the fan, the heating unit and any other components of the hair extension drying device in communication with the controller based on inputs received at the GUI. In various embodiments, each of hair extension drying device 100, hair extension drying device 200 and hair extension drying device 300 can further comprise a plurality of operating buttons 312 provided on the sidewall of the enclosure of the hair extension drying device. Operating buttons 312 can be used to control operations of the air extension drying device, for example, by sending and receiving signals from the controller 221. Stated differently, controller 221 may be in electronic communication of the plurality of operating buttons 312. One of the operating buttons 312 may operate to power on and power off the hair extension drying device. One or more addition buttons may be operable to control the heating temperature or the moisture level within enclosure 3.

Those of skill in the art will recognize that one or more system components such as the controller, for example, may be, or include one or more printed circuit boards (PCB) containing an integrated circuit or circuits for completing the activities described herein. In at least one embodiment, the controller can be in the form of a CPU that includes one or more integrated circuits having firmware for causing the circuitry to complete the activities described herein. Of course, any number of other analog and/or digital components capable of performing the functionality described herein can be provided in place of, or in conjunction with the below described controller elements.

The controller can act to execute program code stored in the memory provided on the device in order to allow the device to perform the functionality described herein. Likewise, a timer module can be provided, and can function to accurately measure the passage of time. As described herein, the timer module can be provided as a function of the processor or can include a separate physical circuit. In either instance, processors and timers are extremely well known in the art, therefore no further description will be provided.

The memory can act to store operating instructions in the form of program code for the controller to execute. The memory can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device. Additionally, the memory can also include one or more cache memories that provide temporary storage of at least some program code in order to reduce the number of times program code must be retrieved from the bulk storage device during execution. Each of these devices is well known in the art.

The device can further include a power unit that includes an AC electrical power transformer and cord (not illustrated) capable of allowing the device to be powered from a standard electrical outlet. Of course, other embodiments are also contemplated wherein the power source can include a plurality of batteries, rechargeable or otherwise. Such a feature can be integrated into a smaller size main body so as to create a portable version of the device for use while traveling, for example.

The input/output unit in the form of the GUI as mentioned herein can be provided to accept user inputs and/or to provide operating information to a device user. The GUI can include or comprise a visual display such as a touch screen, capable of performing two-way communications with a device user. In various embodiments, the GUI and/or the device can include one or more pushbuttons (virtual or otherwise) that are connected to the controller so as to activate the device for a predetermined period of time, such as 15 minutes, for example. Likewise, one or more lights can also be provided as part of the GUI as well as within the enclosure to clearly indicate whether the device is in the ON or OFF operating state.

In this regard, the device can include functionality for allowing a user to select various operating modes. Several variables which can be presented to a device user can include, for example, the ability to select the runtime of the device; to selectively operate fan 6 as well as the other blowers and airflow generating units as mentioned herein in a high, medium and low setting; to operate the fan 6 as well as the other blowers and airflow generating units as mentioned herein without the heating element; and/or to adjust the temperature of the heating element. Of course, any number of other settings is also contemplated.

In one embodiment, the enclosure 3 and the top cover 4 is made of heat resistant and/or durable plastic material that is capable of withstanding operations in a dry or humid environment. In at least one embodiment, the hair extension holder is designed to hold one or more wet hair extensions in between two plates of the hair extension holder. This can allow the hair to maintain its initial shape while allowing the airflow to pass through the individual strands. In one embodiment, four posts 2 operate to keep the hair extension holder elevated from base 12 of enclosure 3, and thus the hair extension away from the negative airflow of the heating unit 5 that in one embodiment can include a vacuum generator (or a negative airflow generator). Lock 8 is designed to maintain closure of top cover 4 while the device is in full operation. In one embodiment, lock 8 can be configured to open with a sliding or lifting motion and close in the reverse.

As described herein, one or more elements of hair extension drying device 100/200/300 (also may be commonly referred to herein as the hair extension drying device) be secured together utilizing any number of known attachment means such as, for example, screws, glue, compression fittings and welds, among others. Moreover, the embodiments herein are described as including separate individual elements, the inventive concepts disclosed herein are not so limiting. To this end, one of skill in the art will recognize that one or more individual elements such as the enclosure 3, fan 6, and heating unit 5, for example, may be formed together as one continuous element, either through manufacturing processes, such as welding, casting, or molding, or through the use of a singular piece of material milled or machined with the aforementioned components forming identifiable sections thereof. In at least one embodiment, one or more of the top cover, the base, and the wall is constructed from a clear (i.e., transparent) material. In at least one embodiment, the hair extension drying device may accommodate or hold up to 6 bundles of 22" hair extension at a time. In some embodiments, various components of the hair extension drying device including the enclosure, the top cover and the base can be provided with a soft touch rubber finish. The hair extension drying device can further include timed auto shut off. The hair extension drying device can further include ion generated heat. The hair extension drying device can further include a cool air temperature setting that can advantageously assist with maintaining shine and hair texture. The hair extension drying device can further include a heat generator that includes features such as heat ion technology as well as a high-speed motor, among others. Ion technology can advantageously reduce frizz, maintains texture, sheen and overall condition of the hair, so that the hair extension drying device can extend the life of the extensions and the wigs aerated or dried using the hair extension drying device as described herein.

According to various embodiments, a method of drying a hair extension includes providing a hair extension drying device such as hair extension drying device 100, hair extension drying device 200 or hair extension drying device 300. The method further includes placing a wet hair extension 217 on or within the hair extension holder 7 or 207 of the device. The method further includes initiating circulation of heat generated by the heating unit within the enclosure by turning on the fan and the heating unit; in one embodiment, this can be accomplished by a user providing one or more inputs to the controller via the GUI. In response to the input received at the GUI, the controller operates to turn on the fan and the heating unit. In one embodiment, the controller can further turn on the airflow generator forming part of heating unit 205. In one embodiment, the controller can furthermore turn on the blower provided on the first opening 11 and/or the blower provided on the second opening 11*a*; accordingly, in at least one embodiment, the method comprises operating a blower positioned on an opening defined on the wall of the enclosure for providing positive air flow or negative air flow through the opening. The controller may thereby operate to control the operation of hair extension drying device 100 or hair extension drying device 200 to remove moisture from a wet hair extension 217 placed within the enclosure. In at least one embodiment, the laterally extending plate comprises two lateral plates in a hinged relationship, wherein the method further comprises placing the hair extension between the two lateral plates. In at least one embodiment, the method further comprises moving air or circulating air through one or more of the perforations or fluid pathways provided on the laterally extending plate(s).

In various embodiments, the method further comprises the controller automatically turning off one or more of the fan and the heating unit (and any other components of the device, as needed) when the humidity as measured by the humidity sensor falls below or is found to be a predetermined value. In various embodiments, the method further comprises the controller automatically turning off one or more of the fan and the heating unit (and any other components of the device, as needed) after a predetermined period of time has elapsed since the turning on of the hair extension drying device 100 or hair extension drying device 200 by the controller.

In at least one embodiment, the device as described herein is equipped with two motive forms to generate airflow as a function of both positive (by way of fan 6) and negative (e.g., by way of the airflow generator of heating unit 205) flow. The opposing operation of the heated flow can create a push and pull effect that when operational will decrease drying time significantly. Fan 6 operates to generate significant airflow under standard AC household current. The orientation of the blades of fan 6 can be sized to allow adequate clearances sufficient to keep the blades from contacting the wall surfaces during operation. Fan 6 operates in sync with the heating unit (that may include an airflow generator in at least one embodiment) also operating under AC household current. Both fan 6 and the airflow generator of the heating unit can each include a screen to keep hair from lodging within the respective motors. Openings defined on base 12 further operate to allow full circulation of air into and outside of the enclosure. Additional vents in the form of first opening 11 and a second opening 11*a* may positioned on opposing sides of the wall 13 to provide further ventilation and/or air circulation.

In one embodiment, columns 9 can be made of hardened rubber wherein the columns 9 operate to elevate the dryer off of any flat surface. The spacing provided by columns 9 can be ideal for allowing venting of the device and for keeping any pooling of liquid substances accumulating under the enclosure from coming in direct contact of the enclosure.

The embodiments as described herein are intended to be for illustrative purposes to disclose the intent of the design. Changes to design, geometry and operational processes could be carried out without digressing from the overall intent of the design.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A hair extension drying device comprising:

an enclosure comprising a base and an upwardly extending wall surrounding the base, the wall operable to receive a top cover of the enclosure;

a fan coupled to the top cover, the fan operable to circulate air within the enclosure;

a heating unit coupled to the base; and a hair extension holder spaced apart from the heating unit by one or more vertical supports, the hair extension holder comprising two lateral plates in a hinged relationship, wherein a hair extension is received between the two lateral plates.

2. The device of claim 1, wherein the top cover includes a lock that secures the top cover to the wall.

3. The device of claim 1, wherein the heating unit comprises a housing secured to the base, wherein the housing comprises an airflow generator.

4. The device of claim 3, wherein the airflow generator generates a negative airflow.

5. The device of claim 1, wherein the at least one of the two lateral plates comprises one or more of perforations and fluid pathways that allow airflow therethrough.

6. The device of claim 1, wherein the enclosure further comprises one or more openings defined on the wall for air circulation.

7. The device of claim 6, wherein at least two of the openings are positioned on opposing sides of the wall.

8. The device of claim 7, wherein at least one opening includes a blower that provides one of positive air flow and negative flow therethrough.

9. The device of claim 1, further comprising a humidity sensor positioned within the enclosure.

10. The device of claim 9, further comprising a controller coupled with the enclosure, wherein the controller automatically turns off one or more of the fan and the heating unit when the humidity as measured by the humidity sensor is below a predetermined value.

11. The device of claim 1, further comprising a controller coupled with the enclosure, wherein the controller automatically turns off one or more of the fan and the heating unit after a predetermined period of time.

12. The device of claim 1, further comprising a graphical user interface (GUI) provided on the enclosure, wherein the GUI is in communication with a controller coupled with the enclosure, wherein the controller directs operations of one or more of the fan, the heating unit and the GUI.

13. The device of claim 1, wherein one or more of the top cover and the wall is constructed from a clear material.

14. A hair extension drying device comprising:

an enclosure comprising a base and an upwardly extending wall surrounding the base, the wall operable to receive a top cover of the enclosure, the top cover including a plurality of vents defined thereon for air circulation;

two openings defined on the wall for air circulation, the two openings positioned on opposing sides of the wall;

wherein at least one of the two openings includes a blower that provides one of positive air flow and negative flow therethrough; and a hair extension support comprising a plurality of prongs extending vertically from the base, wherein, in an operational disposition of the hair extension drying device, a hair extension is placed about the plurality of prongs, and air is circulated within the enclosure by the blower to remove moisture from the hair extension.

15. The device of claim 14, further comprising a heating unit coupled to the base.

16. The device of claim 15, wherein the heating unit comprises a housing secured to the base.

17. The device of claim 14, further comprising a humidity sensor positioned within the enclosure.

18. The device of claim 14, further comprising a heating source coupled to at least one of the plurality of prongs.

19. A hair extension drying device comprising:

an enclosure comprising a base and an upwardly extending wall surrounding the base, the wall operable to receive a top cover of the enclosure;

a fan coupled to the top cover, the fan operable to circulate air within the enclosure;

a heating unit coupled to the base; and a hair extension holder spaced apart from the heating unit by one or more vertical supports, the hair extension holder comprising two lateral plates in a hinged relationship, wherein a wig is received between the two lateral plates.

* * * * *